United States Patent [19]

Voigt

[11] 4,259,848

[45] Apr. 7, 1981

[54] REFRIGERATION SYSTEM

[76] Inventor: Carl A. Voigt, 120 E. Dakota St., Nampa, Id. 83651

[21] Appl. No.: 48,999

[22] Filed: Jun. 15, 1979

[51] Int. Cl.[3] ..... F25B 41/00

[52] U.S. Cl. ..... 62/113; 62/197; 62/513

[58] Field of Search ..... 62/197, 113, 509, 513, 62/196 B

[56] References Cited

U.S. PATENT DOCUMENTS

| | | | |
|---|---|---|---|
| Re. 27,522 | 11/1972 | Schenk et al. | 62/196 B |
| 2,195,228 | 3/1940 | Schwarz | 62/113 |
| 2,244,376 | 6/1941 | Spofford | 62/513 |
| 2,520,045 | 8/1950 | McGrath | 62/513 |
| 2,530,648 | 11/1950 | Cahenzli, Jr. et al. | 62/513 |
| 2,614,394 | 10/1952 | McGrath | 62/196 B |
| 2,665,560 | 1/1954 | Hubbard | 62/513 |
| 2,709,340 | 5/1955 | Webber | 62/513 |
| 2,869,330 | 1/1959 | Kramer | 62/196 B |
| 2,876,629 | 3/1959 | Dube et al. | 62/196 B |
| 2,884,768 | 5/1959 | Gould | 62/513 |
| 2,909,908 | 10/1959 | Pastuhov et al. | 62/513 |
| 2,912,831 | 11/1959 | Palmatier | 62/196 B |
| 2,944,411 | 7/1960 | McGrath | 62/196 B |
| 2,954,681 | 10/1960 | McCormack | 62/196 B |
| 3,044,273 | 7/1962 | Lower et al. | 62/196 B |
| 3,064,449 | 11/1962 | Rigney | 62/513 |
| 3,088,292 | 5/1963 | Kocher | 62/513 |
| 3,103,795 | 9/1963 | Tilney | 62/196 B |
| 3,195,319 | 7/1965 | Wolff | 62/196 B |
| 3,214,932 | 11/1965 | Grant | 62/509 |
| 3,273,356 | 9/1966 | Hoffman | 62/513 |
| 3,389,576 | 7/1968 | Mauer | 62/196 B |
| 3,435,626 | 4/1969 | Wile et al. | 62/196 B |
| 3,726,103 | 4/1973 | Anderson | 62/196 B |
| 3,734,810 | 5/1973 | Davis | 62/196 B |
| 3,851,494 | 12/1974 | Hess | 62/513 |
| 3,872,685 | 5/1975 | Matthis | 62/196 B |
| 3,905,202 | 9/1975 | Taft et al. | 62/196 B |
| 3,933,004 | 1/1976 | Carter | 62/196 B |
| 3,939,668 | 2/1976 | Morris | 62/196 B |
| 3,952,533 | 4/1976 | Johnston et al. | 62/513 |

FOREIGN PATENT DOCUMENTS

| | | |
|---|---|---|
| 1158531 | 8/1960 | Fed. Rep. of Germany . |
| 1376155 | 11/1963 | France . |

*Primary Examiner*—Ronald C. Capossela
*Attorney, Agent, or Firm*—Harvey B. Jacobson

[57] ABSTRACT

A closed circuit refrigeration system having an elongated liquid refrigerant conduit in the high pressure circuit portion which delivers a vapor-free stream of liquid refrigerant to the expansion valve separating the high and low pressure portions of the closed circuit. Vapor formed by exposure of the liquid refrigerant conduit to ambient conditions is withdrawn by a dual suction compressor, and the refrigerant approaching the expansion valve is adiabatically cooled to liquefy any additional vapor formed by the withdrawal of vaporized refrigerant from the high pressure portion of the circuit.

15 Claims, 4 Drawing Figures

REFRIGERATION SYSTEM

BACKGROUND OF THE INVENTION

This invention relates to a refrigeration system of the closed circuit, vapor-compression type, and is related to the invention disclosed in my prior copending application Ser. No. 836,091, filed Sept. 23, 1977 now abandoned.

Refrigeration systems of the foregoing type often have an elongated liquid refrigerant line in the high pressure portion of the circuit, exposed to varying ambient conditions. Because of the pressure drop of a long line and warm ambient temperatures, a portion of the liquid refrigerant may change to vapor during travel before reaching the expansion valve. Where the expansion valve is sized to pass only liquid through its orifice, an insufficient quantity of refrigerant necessary to satisfy the vapor pump or compressor will be passed if there is an excessive amount of vapor in the flow stream of liquid refrigerant upstream of the expansion valve. The expansion valve must therefore be considerably enlarged in orifice size to pass the requisite quantity of refrigerant for maintaining the vapor pump operating under all anticipated conditions. To avoid use of an expansion valve sized to pass the vapor in the liquid flow stream and the problems attendant thereto, pressure boosting facilities are generally utilized to maintain the pressure in the high pressure portion of the circuit at a level above the point at which vapor will form under anticipated varying ambient conditions. Such measures are costly and require higher power consumption for compressor operation.

It is therefore an important object of the present invention to provide an improved refrigeration system of the closed circuit, vapor-compression type which will operate efficiently under varying ambient conditions utilizing an expansion valve sized to pass only liquid refrigerant and without any auxiliary pressure boosting facilities for the high pressure side of the circuit.

SUMMARY OF THE INVENTION

In accordance with the present invention, the liquid refrigerant conducting conduit of a closed circuit, vapor-compression type refrigeration system is connected to a receiver chamber located upstream of the expansion valve separating the high and low pressure portions of the refrigerant circuit. A separated vapor phase is collected within the receiver chamber as a result of partial vaporization of the liquid refrigerant occurring under varying ambient conditions to which the liquid conduit is exposed within the high pressure portion of the circuit. The separated vapor is withdrawn from the receiver chamber at a regulated flow rate by a dual suction type of piston compressor which functions primarily to pressurize the low pressure vapor received from the evaporator. The compressor also applies suction pressure for said withdrawal of the high pressure vapor at the end of its suction stroke. The pressure against which the compressor operates is therefore increased because of the intake of the high pressure vapor by an amount dependent on the vaporization of liquid refrigerant under varying ambient conditions. By modulating the withdrawal flow of the high pressure vapor as a function of compressor loading, the pressure in the piston chamber of the compressor is regulated for optimum compressor operation under all conditions.

Toward that end, a flow control valve controls flow of the high pressure vapor from the receiver chamber to a high pressure vapor port of the compressor opened at the end of each suction stroke. A thermistor embedded in the stator winding of the compressor motor, senses the compressor loading to effect displacement of the flow control valve through an electrically connected heater element.

As a result of the aforesaid regulated withdrawal of high pressure vapor from the high pressure portion of the circuit, additional vapor may be formed in the liquid refrigerant as it approaches the expansion valve sized to pass only liquid. Such additional vapor is liquefied by cooling of the refrigerant in a heat exchanger within which refrigerant on the upstream and downstream sides of the expansion valve is conducted in heat transfer relation to each other. Thus, a vapor-free stream of liquid refrigerant entering the expansion valve is assured without any addition or withdrawal of heat energy from the circuit.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

DETAILED DESCRIPTION OF THE SPECIFIC EMBODIMENTS

Figure 1:
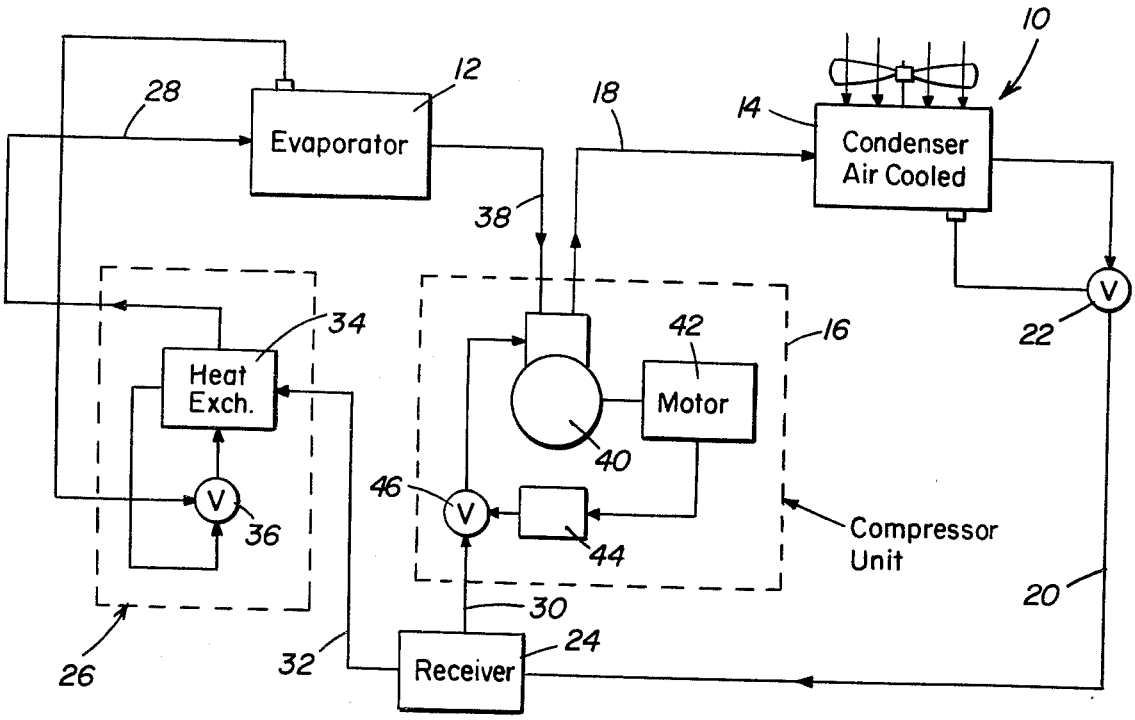
FIG. 1 is a fluid circuit diagram depicting the present invention associated with a single compressor type of air conditioning system.

Referring now to the drawings in detail, FIG. 1 schematically illustrates one type of closed circuit, refrigeration system with which the present invention may be associated. The system shown is of the single vapor pump, air conditioning type generally referred to be reference numeral 10 which includes the usual external heat absorbing evaporator component 12 through which the air conditioned space is cooled by absorption of heat, and an air-cooled type of condenser 14 through which the heat absorbed by the system is discharged to atmosphere externally of the air conditioned space. In this system, a refrigerant vapor pump or compressor unit generally referred to by reference numeral 16 supplies refrigerant in a vapor state under a relatively high pressure through a discharge line 18 to the condenser 14. The refrigerant is converted into its liquid state by the condenser and discharged under the high pressure generated by the compressor unit for flow through liquid refrigerant conduit 20 connected to the condenser by a sub-cooling valve 22. In accordance with the present invention, the conduit 20 passes the liquid refrigerant in series through a liquid vapor separator 24 and an expansion valve unit 26 before entering the evaporator 12 through a feedback inlet line 28 as low pressure liquid-vapor refrigerant.

Vapor that forms in the high pressure liquid refrigerant conduit 20 is separated out and fed from separator 20 under a suction pressure momentarily applied through vapor line 30 for recycling back into the system. Accordingly, liquid refrigerant substantially free of vapor is conducted from the separator 24 through feeder line 32 to a heat exchanger 34 associated with the expansion valve unit 26. The liquid refrigerant is conducted through the heat exchanger 34 and a conventional type of expansion valve 36 sized to conduct only liquid through its orifice. Within the heat exchange 34, the refrigerant under high pressure passes in heat exchange relation to refrigerant under low pressure on the discharge side of the expansion valve 36 before entering the evaporator. Any vapor formed as a result of the pressure drop caused by vapor outflow from the separator 24 is thereby converted back to its liquid state. No refrigeration gain or loss occurs within the heat exchanger 34, which operates merely to insure that only liquid refrigerant passes through the expansion valve 36.

The vaporized refrigerant under low pressure enters the compressor unit 16 from the evaporator through inlet line 38 as shown in FIG. 1, so that it may be compressed and raised to the high pressure level in discharge line 18. The compressor device 40, within which the vapor refrigerant is compressed, is driven by an electric motor 42. The operating temperature of the motor in accordance with the present invention is operative through an electronic valve control 44 to modulate the flow of high pressure vapor to the compressor device through a valve 46 interconnecting the compressor device with the vapor outlet line 30 from the separator 24.

Figure 2:
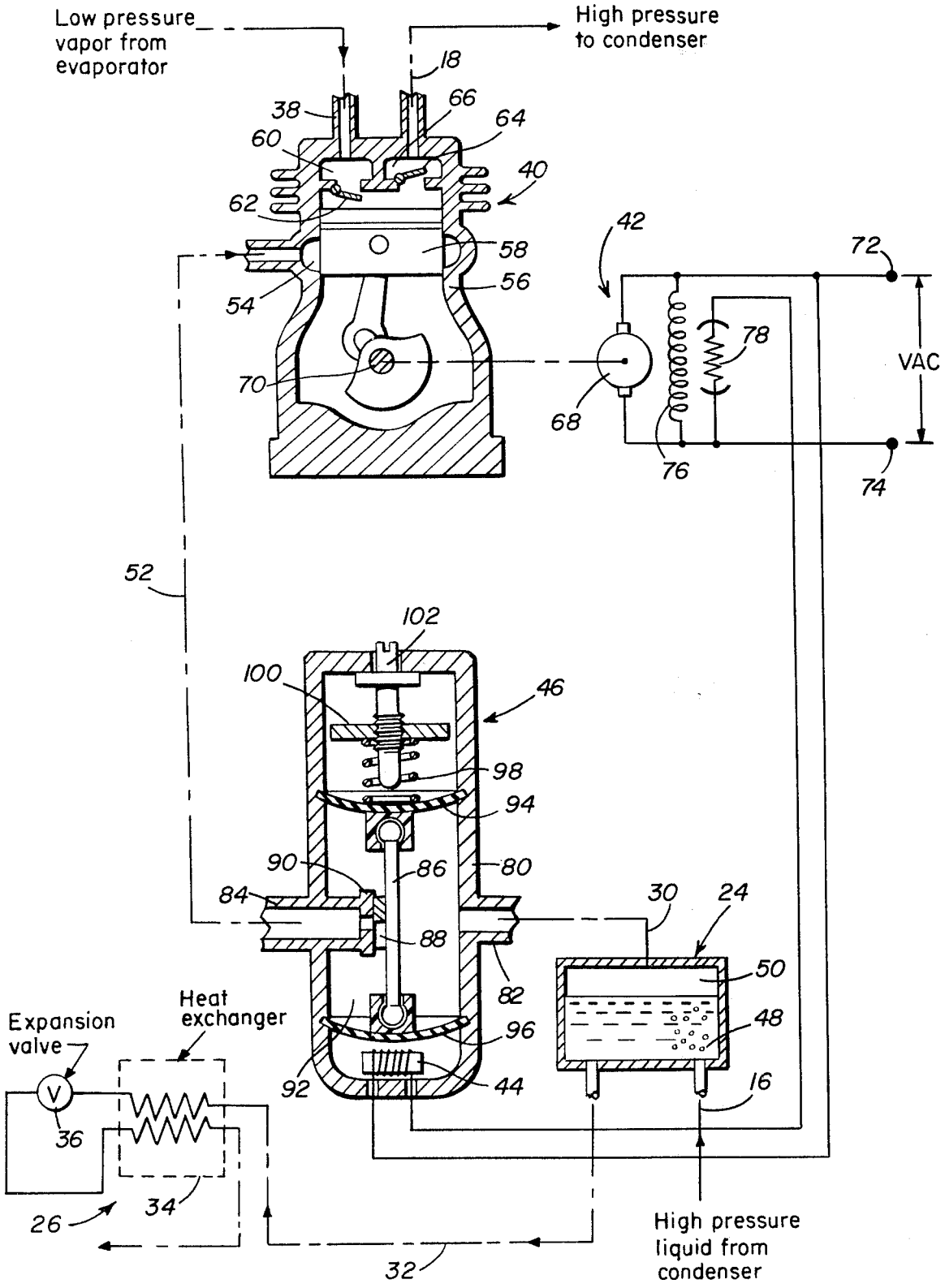
FIG. 2 is a more detailed circuit diagram and section view through circuit components forming the improved portion of the refrigerant circuit associated with the system depicted in FIG. 1.

Referring now to FIG. 2, the separator 24 is in the form of a receiver chamber within which a body of high pressure liquid refrigerant 48 is accumulated for supply through line 32 to the expansion valve unit 26. Vapor entrained in the liquid refrigerant, separates from the liquid and is withdrawn from the vapor space 50 by suction pressure in line 30 connected to valve 46. This high pressure vapor is conducted by valve 46 to the compressor device through line 52 connected to a vapor port 54 on the side of a cylinder housing 56 associated with the compressor device 40. The compressor device 40 includes a piston 58 reciprocated within the cylinder housing having a low pressure head space 60 to which the low pressure vapor inlet line 38 is connected. A one-way check valve 62 admits low pressure vapor into the piston cylinder during the piston suction stroke. At the end of the suction stroke, the piston 58 uncovers the vapor inlet port 54 in order to momentarily apply suction pressure through the valve 46 to the vapor space 50 in separator 24 in order to effect withdrawal of high pressure vapor from the high pressure refrigerant conduit to the compressor unit. During the compression stroke of the piston 58, the vapor inlet port 54 is closed as well as the check valve 62. Check valve 64 is then opened to admit pressurized vapor into high pressure head space 66 connected to the discharge line 18.

The motor 42 as shown in FIG. 2 has its rotor 68 mechanically coupled to the piston operating crank shaft 70 of the compressor device and is electrically connected across a 24 volt power source at power terminals 72 and 74. The motor may be of a conventional type suitable for drive of compressors including, for example, a parallel connected stator winding 76 with which a thermistor type temperature sensor 78 is associated. In order to monitor the loading on the compressor device, the thermistor 78 is embedded midway between the ends of the stator winding 76 along a portion closest to the armature rotor 68. An appropriate temperature sensing signal is thereby provided reflecting the loading imposed by the compressor device on the motor. The thermistor is electrically connected in series with the valve control 44 across the power terminals 72 and 74 in order to control the vapor flow valve 46.

The vapor flow valve 46, as shown in FIG. 2, includes a valve housing 80 having inlet 82 and an outlet 84 to which the lines 30 and 52 are respectively connected. A reciprocable valve stem 86 is positioned within the housing 80 and mounts a valve element 88 adapted to engage valve seat 90 to control the outflow of vapor through outlet 84. A valve chamber 92, within which the valve element 88 is located, is sealed by axially spaced diaphragms 94 and 96 to which the ends of the valve stem 86 are coupled. An axial bias is applied to the valve stem 86 through diaphragm 94 by means of a spring 98 reacting between the diaphragm 94 and an adjustable nut element 100. The position of the nut element 100 within the valve housing is adjusted by rotation of a threaded adjustment element 102 in order to vary the bias exerted by the spring 98. The valve stem and valve element may be displaced against the bias of spring 98 in response to heat electrically generated by heating element 44 enclosed within a sealed vapor chamber 104 on one side of the diaphragm 96 opposite the valve chamber 92. The chamber 104 is filled with vapor to effect displacement of the diaphragm 96 in response to heating thereof by the element 44.

It will be apparent that when the load of the compressor increases, the heat generated in the stator winding 76 increases the resistance of the thermistor 78 as a result of which the energy supplied to the heater element 44 decreases to cause the valve element 88 to move toward a closed position under the bias of spring 98. On the other hand, when the temperature of the motor decreases, the resistance of the thermistor 78 decreases so that more electrical energy is supplied to the heater element 44 causing displacement of the valve element toward the open position. The variation in heat produced in the motor 42 as a result of variations in load on the compressor, therefore, modulates the flow of high pressure vapor from the separator 24 to the compressor device 40 in order to maintain the system operating at full efficiency over a wide range of operating temperatures and corresponding compressor loading.

Figure 3:
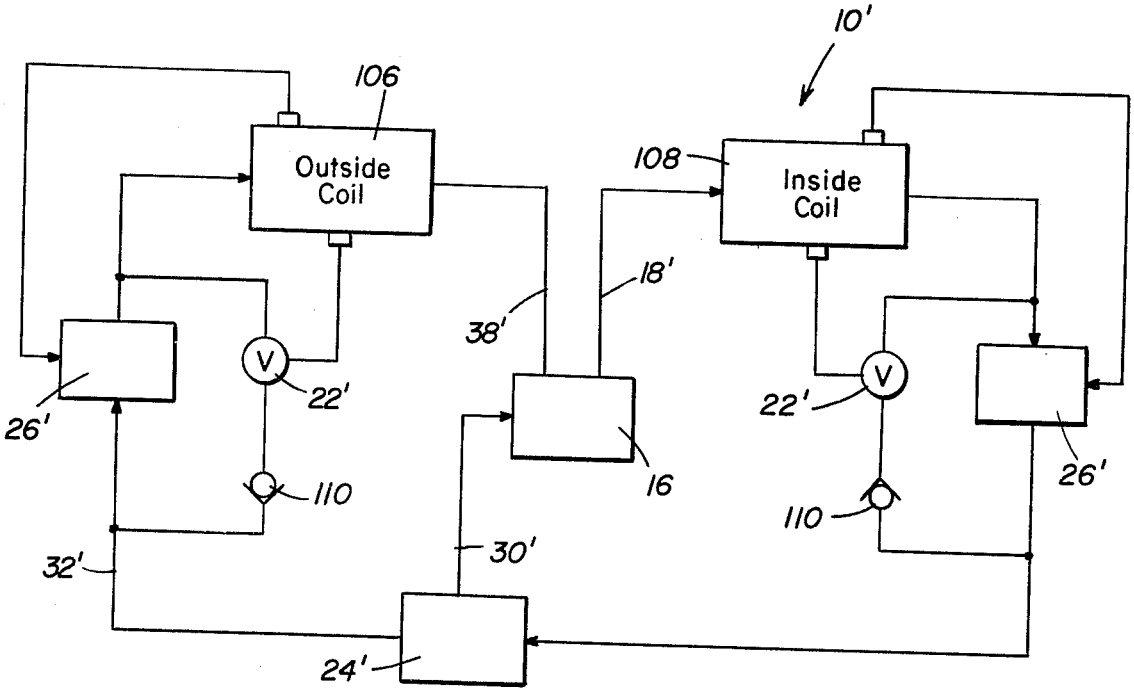
FIG. 3 is a fluid circuit diagram depicting the present invention associated with a reversible heat pump system.

FIG. 3 illustrates application of the present invention to a heat pump system generally referred to by reference numeral 10'. In such a system there is an outside coil 106 and an inside coil 108 through which heat is either absorbed or discharged. A single compressor unit 16', similar to compressor unit 16 described with respect to FIGS. 1 and 2, is associated with the heat pump system 10' for compressing vapor refrigerant conducted thereto through line 38' in a heating mode of operation and supplying high pressure refrigerant to line 18'. Vapor is also intermittantly recycled back to the compressor unit 16' from a separator 24' through line 30' in order to supply liquid refrigerant substantially free of vapor through line 32' to coil 106 through an expansion valve unit 26', similar to unit 26 described with respect to FIGS. 1 and 2. In order to enable operation of the system 10' in a cooling mode, a reverse flow path in parallel with the expansion valve unit 26' is provided including a check valve 110 in series with a sub-cooling valve 22'. A similar arrangement is associated with the other coil 108 including another expansion valve unit 26', check valve 110 and sub-cooling valve 22'. The improvement produced by the present invention with respect to system 10' is achieved by means of the compressor unit 16', separator 24' and expansion valve unit 26' as hereinbefore described with respect to FIGS. 1 and 2.

Figure 4:
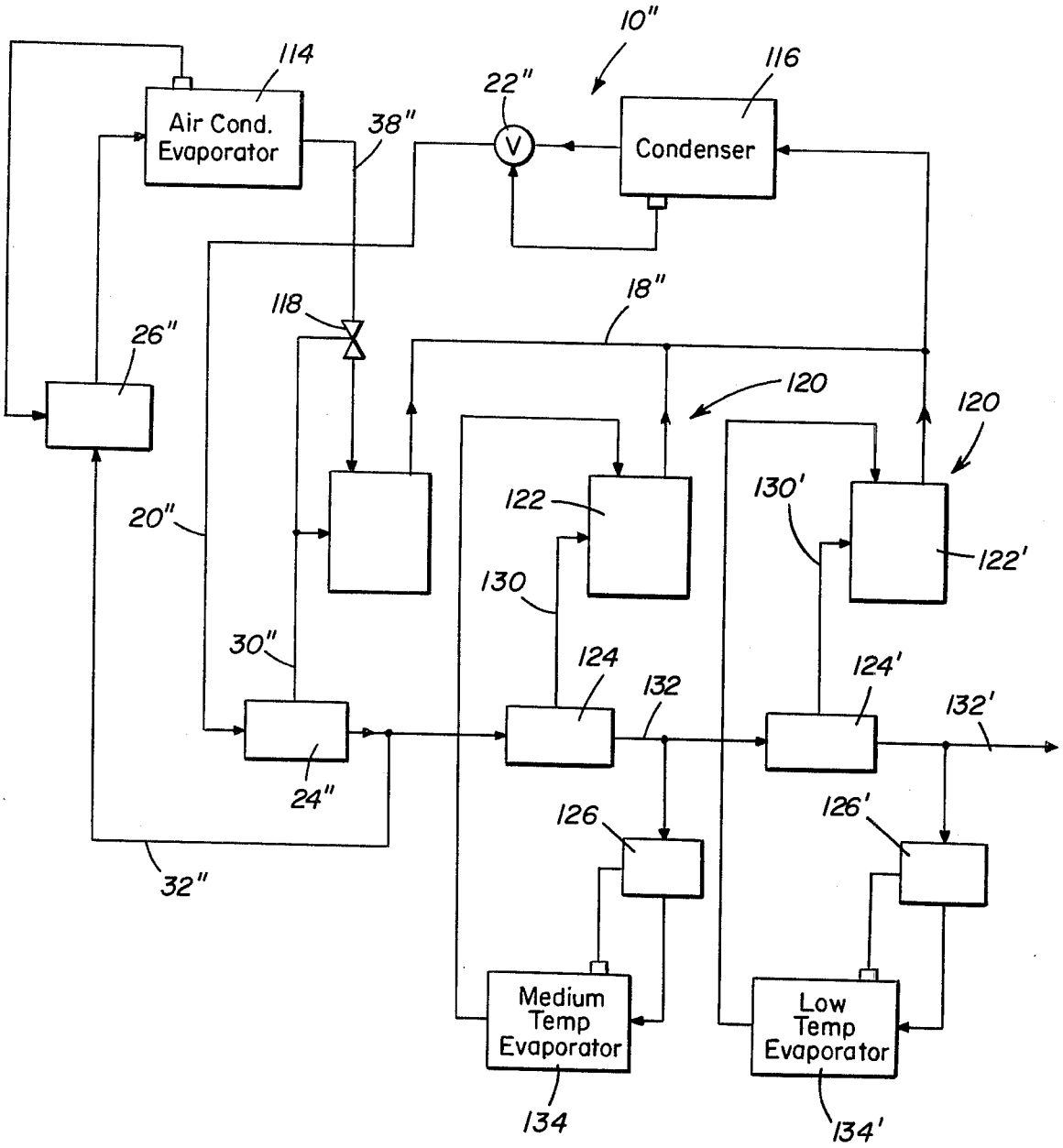
FIG. 4 is a fluid circuit diagram depicting the present invention associated with a multi-temperature, plural compressor type of air conditioning system.

The present invention may also be applied to other refrigeration systems of the closed circuit, vapor-compression type, such as the multi-temperature, plural compressor air conditioning system 10" illustrated in FIG. 4. The system 10" includes a main evaporator 114 and a common condenser 116 as well as a main compressor unit 16" supplying high pressure refrigerant vapor to the condenser through a discharge line 18". Low pressure refrigerant is fed from the evaporator 114 through line 38" to the compressor unit 16" through a three-way valve 118 having an inlet port connected to the high pressure vapor line 30" connecting separator 24" with the compressor unit 16". When the air conditioning temperature is satisfied, valve 118 opens the high pressure vapor line 30" to the suction pressure in line 38". The separator 24" receives high pressure liquid refrigerant from the common condenser 116 through a sub-cooling valve 22" and high pressure liquid refrigerant line 20". The liquid refrigerant leaving the separator 24" is supplied to an expansion valve unit 26" by line 32" in order to feed a vapor-free liquid refrigerant to the expansion valve in valve unit 26", as hereinbefore described with respect to the valve unit 26 of FIGS. 1 and 2.

The liquid refrigerant outflow line 32" extending from the separator 24" also feeds liquid refrigerant to a plurality of additional stages 120 and 120' of the system 10", as shown in FIG. 4. Each stage includes a compressor unit 122 or 122', similar to the compressor unit 16 hereinbefore described with respect to FIGS. 1 and 2, a separator 124 or 124', similar to the separator 24 hereinbefore described, and an expansion valve unit 126 or 126', similar to the expansion valve unit 26 hereinbefore described. The vapor outlet 130 or 130' from the separator 124 or 124' accordingly extends to the high pressure vapor suction port associated with the compressor unit 122 or 122', while the liquid refrigerant outlet line 132 or 132' from the separator 124 or 124' is connected to the expansion valve unit 126 or 126'. The line 132 of stage 120 is also connected to the liquid refrigerant inlet of the separator 124' associated with following stage 120' of the system. A medium cooling effect is thereby obtained through the evaporator 134 associated with the stage 120. A low temperature evaporator 134' is associated with the following stage 120' of the system. The high pressure discharge ports of the compressor units 122 and 122' are connected to the common discharge line 18" through which high pressure refrigerant vapor is fed to the common condenser 116.

Each of the refrigeration systems hereinbefore described is of the closed circuit type and utilizes the usual and conventional components, except for the separator 24, the heat exchanger 34 associated with the expansion valve 36 and the motor-temperature controlled vapor flow valve 46 interconnecting the separator 24 with a high pressure vapor inlet port 54 associated with the compressor 40, as depicted in FIG. 2. Any excessive heat absorbed by the liquid refrigerant in the high pressure circuit portion of the system tending to raise the liquid temperature above evaporator temperature, is removed by permitting vaporization and withdrawal of vapor through separator 24 to the high pressure vapor port 54 of the compressor before the liquid enters the expansion valve. Thus, the compressor will operate against a higher pressure than that ordinarily presented by the low pressure circuit portion of the system. The increase in pressure applied to the compressor through the vapor inlet port 54 is controlled by the thermistor 78 through valve 46 to enable the compressor to operate at the most efficient pressure. Because of the withdrawal of vapor and the resulting pressure drop in the line, the liquid reaching the expansion valve may have some additional vapor formed therein. In view thereof, heat is transferred by the heat exchanger 34 from the high pressure refrigerant, as it approaches the expansion valve 36, to the lower pressure liquid-vapor refrigerant discharged from the expansion valve. A vapor-free stream of liquid entering the expansion valve is thereby assured by the exchanger 34 operating to cool the high pressure refrigerant adiabatically or without the addition to or removal of any energy from the refrigerant within the unit 26 which separates the high and low pressure portions of the closed circuit.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a closed refrigeration system having low and high pressure circuit portions separated by an expansion valve sized to pass only refrigerant in a liquid state and a compressor for the pressurizing the refrigerant in the high pressure circuit portion, means for maintaining a vapor-free flow of liquid refrigerant to the expansion valve from the high pressure circuit portion, comprising chamber means connected to the high pressure circuit portion for separation of vapor produced by partial vaporization of the liquid refrigerant under variable ambient conditions, vapor removing means connected to the chamber means for withdrawal of said separated vapor from the chamber means, and heat exchange means for cooling refrigerant approaching the expansion valve from the high pressure circuit portion by flow in heat transfer relation to the refrigerant departing from the expansion valve in the low pressure circuit portion to liquefy any additional vapor formed in response to said withdrawal of the separated vapor.

2. The combination of claim 1 wherein said vapor removing means includes a high pressure vapor port connected to the compressor, and valve means connecting said vapor port to the chamber means for modulating said withdrawal of the separated vapor from the chamber means.

3. The combination of claim 2 including thermal sensing means connected to the valve means for controlling flow of the separated vapor as a function of loading on the compressor.

4. The combination of claim 3 wherein said refrigeration system includes an evaporator in the low pressure circuit portion downstream of the expansion valve and the heat exchange means, and a condenser in the high pressure circuit portion upstream of the chamber means.

5. The combination of claim 1 wherein said refrigeration system includes an evaporator in the low pressure circuit portion downstream of the expansion valve and the heat exchange means, and a condenser in the high pressure circuit portion upstream of the chamber means.

6. The combination of claim 5 wherein said vapor removing means includes a high pressure vapor port connected to the compressor, and valve means connecting said vapor port to the chamber means for modulating said withdrawal of the separated vapor from the chamber means.

7. In combination with a refrigeration system having a compressor receiving refrigerant under a low pressure in a vapor state from an evaporator and delivering said refrigerant under a high pressure to a condenser through which the refrigerant is converted to a liquid state for recirculation through a high pressure liquid conduit and an expansion valve to the evaporator, the improvement residing in means for maintaining a vapor-free flow of liquid refrigerant to the expansion valve, including separator means connected to the conduit for separating vapor produced by partial vaporization of the liquid refrigerant in the conduit, and suction applying means connecting the compressor to the separator means for withdrawal of separated vaporized refrigerant therefrom.

8. The combination of claim 7 including valve means connected to the suction applying means for modulating flow of the vaporized refrigerant from the separator means as a function of loading on the compressor.

9. The combination of claim 7 including heat exchange means conducting the refrigerant approaching and departing from the expansion valve in heat transfer relation to each other for liquifying any vapor formed in the refrigerant approaching the expansion valve because of said withdrawal of refrigerant by the suction applying means.

10. In a closed refrigeration system having low and high pressure circuit portions separated by an expansion valve sized to pass only refrigerant in a liquid state and a compressor for pressurizing the refrigerant in the high pressure circuit portion, a method for maintaining a vapor-free stream of liquid refrigerant entering the expansion valve from the high pressure circuit portion, including the steps of: permitting vaporization of liquid refrigerant in the high pressure circuit portion under variable ambient conditions; withdrawing the vaporized refrigerant from the high pressure circuit portion at a regulated rate; and liquifying vapor formed by said regulated withdrawal of the vaporized refrigerant.

11. The method of claim 10 wherein liquifying of vapor in the refrigerant is effected by conducting the refrigerant approaching the expansion valve in heat exchange relation to the refrigerant departing from the expansion valve.

12. The method of claim 11 wherein said vaporized refrigerant is withdrawn under a suction pressure intermittantly applied by the compressor for flow at the regulated rate determined by the loading of the compressor.

13. The method of claim 10 wherein said vaporized refrigerant is withdrawn under a suction pressure intermittantly applied by the compressor for flow at the regulated rate determined by the loading of the compressor.

14. In a closed refrigeration system having low and high pressure circuit portions separated by an expansion valve sized to pass only refrigerant in a liquid state and a compressor for pressurizing the refrigerant in the high pressure circuit portion, means for maintaining a vapor-free flow of liquid refrigerant through the expansion valve, comprising chamber means for collecting vapor produced by partial vaporization of the liquid refrigerant in the high pressure circuit portion, vapor removing means connecting the chamber means to the compressor for withdrawal of the vapor collected therein, valve means connected to the vapor removing means for modulating flow of the collected vapor from the chamber means, and sensing means connected to the valve means for controlling said flow of the collected vapor as a function of loading on the compressor.

15. In a refrigeration system having a condenser, a receiver, an external heat absorbing evaporator through which flow of a refrigerant is induced by a pump arranged in a closed system, and an expansion valve sized to efficiently pass the refrigerant only in a liquid state between the receiver and the evaporator, a flash gas remover for liquifying gaseous refrigerant conducted to the expansion valve including a feedback line connecting the expansion valve and the evaporator, a feeder line connecting the expansion valve and the receiver independently of the evaporator, and heat exchange means conducting the refrigerant in said feeder line in heat transfer relation to said feedback line for cooling the refrigerant in said feeder line approaching the expansion valve to liquify gaseous refrigerant.

* * * * *

Disclaimer 4,259,848.—*Carl A. Voigt,* Nampa, Idaho. REFRIGERATION SYSTEM. Patent dated Apr. 7, 1981. Disclaimer filed Dec. 13, 1982, by the inventor.

Hereby enters this disclaimer to claims 7, 9 and 12 of said patent.

[*Official Gazette March 8, 1983.*]